United States Patent [19]

Helmer

[11] 4,070,969

[45] Jan. 31, 1978

[54] METHOD FOR STRENGTHENING LITHOGRAPHIC PRINTING PLATE IMAGES

[75] Inventor: Jack R. Helmer, River Falls, Wis.

[73] Assignee: Minnesota Mining and Manufacturing Company, St. Paul, Minn.

[21] Appl. No.: 705,874

[22] Filed: July 16, 1976

[51] Int. Cl.[2] ..... B41N 3/00; B41C 1/10

[52] U.S. Cl. ..... 101/465; 101/457; 101/467

[58] Field of Search ..... 101/457, 458, 462, 465, 101/466, 467

[56] References Cited

U.S. PATENT DOCUMENTS

| | | | |
|---|---|---|---|
| 3,169,065 | 2/1965 | Sorkin et al. | 101/457 |
| 3,196,785 | 7/1965 | Eissler | 101/465 |
| 3,261,285 | 7/1966 | Sorkin | 101/466 |
| 3,373,021 | 3/1968 | Adams et al. | 101/467 |
| 3,445,224 | 5/1969 | Bach et al. | 101/457 |
| 3,549,365 | 12/1970 | Thomas | 101/457 |
| 3,549,372 | 12/1970 | Richlin et al. | 101/457 |
| 3,554,751 | 1/1971 | Thomas | 101/467 |
| 3,573,041 | 3/1971 | Van Engeland et al. | 101/465 |

OTHER PUBLICATIONS

The CONDENSED CHEMICAL DICTIONARY 1961, Reinhold Publishing Corp. Sixth Edition, New York, N.Y., p. 1145.

*Primary Examiner*—Clyde I. Coughenour
*Attorney, Agent, or Firm*—Cruzan Alexander; Donald M. Sell; Gerald F. Chernivec

[57] ABSTRACT

Aluminum based lithographic printing plates are treated with triethanolamine titanate and heat to impart added solvent resistance and strength to non-crosslinked ink-receptive image areas, thereby affording an increase in press life.

2 Claims, No Drawings

METHOD FOR STRENGTHENING LITHOGRAPHIC PRINTING PLATE IMAGES

BACKGROUND OF THE INVENTION

This invention relates to the treatment of lithographic printing plates, and more particularly to the treatment thereof with an organic titanate solution to thereby strengthen resin image areas and increase the solvent resistance thereof.

Lithographic printing plates typically consist of oleophilic or ink receptive image areas and hydrophilic background areas. As was discussed in U.S. Pat. No. 3,136,637, the oleophilic image areas are subject to abrasion during the printing process and to the effects of harsh solvent treatments, often resulting in a reduction in ultimate press life of such plates. Furthermore, lithographic aluminum surfaces, which conventionally provide the background areas of the plate, are known to be easily oxidized. As such oxidation occurs the hydrophilic surface can tend to become somewhat oleophilic in nature and when printing ink contacts this surface, toning or scumming results. Such a condition necessitates the use of other chemicals, such as acids, to restore the original hydrophilic nature of the substrate. Further, exposure of the aluminum surface to elevated temperatures, such as during post treatment of the plate, often accelerates the tendency towards oxidation and thus toning.

Electrostatically imaged printing plates, whose toner powder image areas are typically composed of a finely divided particulate mixture of resin, carbon black and magnetite, require heat treatment to fix the powder image to the substrate. In the case of aluminum substrates, the heat fixing can adversely effect the background areas to again increase the tendency towards toning and correspondingly reduce press life. A method of allowing heat fixing while allaying the problem of toning has long been sought.

The aforementioned plates also react adversely to certain types of press-wash, solvents and ultraviolet-cured printing inks. These inks and the solvents recommended for use with them can reduce the adhesion of conventional resin images to the substrate and/or weaken the internal strength of the image-forming resin. In either case the predicted useful life of the plate on the printing press can be severely limited. Also, dampening solutions, and particularly those containing isopropyl alcohol, have a tendency to lessen the press life of the printing plate by slightly solvating the resin-capped images.

One common method for increasing the resistance of the image areas to solvents and the strength of the image area is by utilizing crosslinkable photopolymer systems as the image forming material on the lithographic plate. This then provides tough, durable image areas. However, electrostatic images and those formed from light sensitive systems which do not crosslink upon light exposure, e.g. conventional diazo resins, can be definitely enhanced by treatment as hereinafter described. Furthermore, the hydrophilic background areas are effectively preseved by the described treatment and their tendency to oxidize is reduced.

SUMMARY OF THE INVENTION

In accordance with the invention, there is provided a method for strengthening conventional ink-receptive image areas on a lithographic plate comprising coating the image areas with a triethanolamine titanate solution followed by heating the coated image areas at a temperature sufficient to cause the image areas to harden and become insolubilized to common solvents utilized in the printing industry.

DETAILED DESCRIPTION OF THE INVENTION

Organic titanates have been described in various patents, e.g., U.S. Pat. No. 2,898,229 and U.S. Pat. No. 2,736,721, as useful in treating a variety of substrates to improve their adhesion properties for subsequent application of other coatings. Furthermore, U.S. Pat. No. 3,342,601 describes the use of titanium compounds such as the titanium orthoesters to provide a hydrophilic, lithographic printing surface on an aluminum substrate to which can be adhered light-sensitive coatings. However, none of these describes the use of titanium complexes to treat an exposed and developed printing plate so as to preserve the hydrophilic character of the background while providing solvent resistance and strength to the oleophilic image areas.

To practice the process of the invention, a light-sensitive plate can be imaged by light and developed in conventional fashion. Following imaging, a solution of triethanolamine titanate is applied over the entire plate surface, the solvent evaporated, and the plate heated for a period of time sufficient to harden the image, preferably at about 295° C for about 3 minutes.

In the case of an electrostatic or electrographic imaging process, the same procedure as above can be utilized, or, alternatively, an aluminum substrate can be treated and the solvent removed prior to imaging, with the results being the same.

The titanate complex which has been found useful for the practice of this invention is triethanolamine titanate, viz. $(C_3H_7O)_2Ti—[OCH_2CH_2N(CH_2CH_2OH)_2]_2$. Triethanolamine titanate is available commercially in an isopropanol solution from the du Pont Company, under the tradmark "Tyzor" TE.

The optimal concentration of the titanate solution will vary depending on the image concentration of the plate to be treated. For example, electrostatic or electrographic images are more concentrated, i.e., have a greater thickness, than conventional light sensitive systems, and therefore greater titanate concentration is necessary to effectuate treatment thereof. Typically, titanate concentrations of from about 5 to about 20 percent by weight are acceptable, with from about 6 to about 16 percent being preferred. The concentration utilized should depend on the image concentration or thickness, with higher concentrations being utilized for denser image areas. At titanate concentrations greater than about 20 percent by weight, no beneficial effect on the image is noted, and in some instances, a detrimental effect, e.g., a weakening of the image, may be noted.

While not wishing to be limited by theory, apparently the triethanolamine complexes with the resin or toner powder image areas, and upon heating thereof the image areas harden and become insoluble in common press solvents.

Heating of the treated image areas should be undertaken for sufficient time to cause the strengthening of the image areas. Higher temperatures generally require shorter heating times and vica versa. Temperatures as low as 300° F. can be utilized effectively if the time of heating is extended to, for example, 30 minutes. At a temperature of 450° F., a time of only 2 minutes has been found satifactory. Excessively high temperatures, i.e., greater than about 500° F. should be avoided since they may be detrimental to the plate substance and/or image constituents.

The following examples serve to more specifically illustrate the practice of this invention, but should not be read to in any way limit it. All parts are by weight unless otherwise specified.

EXAMPLE 1

A toner-powder image consisting of a mixture of finely divided epoxy resin, carbon black and magnetite, and measuring 3.175 cm., was wiped onto an aluminum substrate then heat fused to the substance. One-half of the prepared plate was coated with a 12 percent by weight solution of triethanolamine titanate in isopropanol by wiping the solution onto the plate so as to not leave ridges or drying patterns. After heating for 5 minutes at 254.4° C., the sample was cut into a disc shape suitable for mounting on a Taber Model 503 Standard Abraser Tester, commercially available from the Teledyne Taber Corp. After 100 cycles of the Teledyne Taber machine, approximately four times the amount of toner powder image had been removed from the non-treated areas as had been removed from the treated area.

EXAMPLE 2

A conventional diazo negative active lithographic plate was exposed to a source of ultraviolet light through a negative mask and developed. On half of the exposed and developed plate a 6 percent by weight solution of triethanolamine titanate in isopropanol was wiped, by hand, leaving a smooth, undistorted surface. The plate was heated in a 294.4° C. oven for 3 minutes, then allowed to cool to room temperature. Samples of several ultraviolet inks, e.g. IPI Ultra King manufactured by the Inmont Corp., Tru-Dot manufactured by Canada Printing Ink. Co. Ltd., Borden Printing Inks manufactured by the Borden Co., and Sun Chemical Corporation's GPI Ink, were wiped by hand onto both the treated and non-treated sections of the plate. Both sections were then simultaneously scrubbed by hand, whereupon the loss of image on the non-treated surface was visibly evident, while the treated image remained unchanged.

EXAMPLE 3

Negative-acting lithographic plates prepared and treated as described in Example 2 were wiped by hand with acetone and methylethylketone. The untreated surface image was removed whereas the treated surface showed no visible change.

EXAMPLE 4

A series of positive-acting lithographic plates consisting of Type S.P. and T260 plates manufactured by the Minnesota Mining and Manufacturing Company, Enco Premium plate manufactured by American Hoechst Corp. were exposed to a positive light mask and developed so that a solid image extended in a bank of 2.54 cm. across the plate. Half of each plate was then treated with a 6 percent solution by weight of triethanolamine titanate in isopropanol, heated to 294.4° C. for 3 minutes, cooled to room temperature and rinsed with water. The plates were then scrubbed by hand with methylethylketone. The untreated image dissipated rapidly whereas the treated image remained intact.

Various modifications and alterations of this invention will occur to those skilled in the art without departing from the scope and spirit of this invention.

What is claimed is:

1. A process of strengthening lithographic plates comprising:

a. providing an exposed and developed olephilic image aluminum-based lithographic printing plate containing non-crosslinked resinous image areas thereon and hydrophilic non-image areas;

b. preserving the hydrophilic non-image areas and strengthening the image areas by applying a solution of triethanolamine titanate; and c. heating the solution coated plate.

2. The process of claim 1 wherein said solution comprises from about 5 to about 20 percent by weight of said titanate in isopropyl alcohol.

* * * * *